US008458986B2

(12) United States Patent
Reyes et al.

(10) Patent No.: US 8,458,986 B2
(45) Date of Patent: Jun. 11, 2013

(54) GUY ANCHOR REINFORCEMENT

(75) Inventors: Jaime Reyes, Grapevine, TX (US); Hanming You, Carrollton, TX (US)

(73) Assignee: ATC IP LLC, Boston, MA (US)

( * ) Notice: Subject to any disclaimer, the term of this patent is extended or adjusted under 35 U.S.C. 154(b) by 0 days.

(21) Appl. No.: 13/592,475

(22) Filed: Aug. 23, 2012

(65) Prior Publication Data

US 2013/0000244 A1 Jan. 3, 2013

Related U.S. Application Data

(62) Division of application No. 12/890,565, filed on Sep. 24, 2010, now Pat. No. 8,250,817.

(60) Provisional application No. 61/363,620, filed on Jul. 12, 2010, provisional application No. 61/361,900, filed on Jul. 6, 2010.

(51) Int. Cl.
*E02D 5/74* (2006.01)
*E02D 5/80* (2006.01)
*E02D 27/32* (2006.01)

(52) U.S. Cl.
USPC ..... 52/745.21; 52/741.1; 52/745.2

(58) Field of Classification Search
USPC ..... 52/169.1–169.14, 170, 79.11, 292, 52/741.1, 745.17, 745.2, 745.21, 293.1, 293.2, 52/293.3, 294–299, 155–165
See application file for complete search history.

(56) References Cited

U.S. PATENT DOCUMENTS 1,777,469 A 10/1930 Luippold et al.
3,256,694 A 6/1966 Siedenhans
3,368,319 A 2/1968 Werner et al.
3,541,798 A * 11/1970 Schnabel, Jr. ..... 405/262
3,744,192 A 7/1973 Burnett
3,936,924 A 2/1976 Ichise et al.
4,036,137 A 7/1977 Dietrich
4,103,618 A 8/1978 Dietrich
4,126,972 A 11/1978 Silen
4,180,952 A 1/1980 Vanderlyn
4,435,931 A 3/1984 Newbanks
4,725,168 A * 2/1988 Fagundes ..... 405/262

(Continued)

OTHER PUBLICATIONS

David K Davies, "Guy Anchor Rod Corrosion: Probability, Self Inspection, Detection, and Prevention," www.eriinc.com, Electronic Research, Inc., 7777 Gardner Road, Chandler, Indiana 47910-9219, Jan. 16, 2009.

(Continued)

*Primary Examiner* — Jeanette E. Chapman
(74) *Attorney, Agent, or Firm* — BainwoodHuang

(57) ABSTRACT

A reinforcing system for a guy anchor used in a guyed or additionally guyed tower includes a concrete structure formed around the guy anchor. The concrete structure has a top surface slightly above grade level. The reinforcing system further includes a supplemental anchor shaft. The supplemental anchor shaft is attached to the existing anchor head and extends down into the concrete structure, where it is retained and encased therein. The concrete structure preferably has a base and at least one wall that extends down from the base and has a surface that faces the tower to resist horizontal forces. The reinforcing system is sufficiently strong to keep the guy anchor in place even if the original anchor shaft completely corrodes. The supplemental anchor shaft does not generally come into contact with soil. It therefore resists corrosion and is expected to provide a long service life.

18 Claims, 8 Drawing Sheets

U.S. PATENT DOCUMENTS

| | | | | |
|---|---|---|---|---|
| 4,776,140 | A * | 10/1988 | Wight et al. | 52/125.5 |
| 4,882,891 | A * | 11/1989 | Sero et al. | 52/741.15 |
| 5,243,795 | A | 9/1993 | Roberts | |
| 5,819,483 | A | 10/1998 | Wells | |
| 6,256,942 | B1 | 7/2001 | Schatz | |
| 6,311,565 | B1 | 11/2001 | Hinz et al. | |
| 6,474,028 | B2 | 11/2002 | Cusimano et al. | |
| 7,827,741 | B2 | 11/2010 | Davies et al. | |
| 7,985,038 | B2 * | 7/2011 | Kwon et al. | 405/262 |
| 8,151,528 | B2 * | 4/2012 | Masters et al. | 52/295 |
| 2003/0121219 | A1 | 7/2003 | Dietel | |
| 2007/0193129 | A1 | 8/2007 | Mansfield | |
| 2008/0193224 | A1 | 8/2008 | Davies et al. | |

OTHER PUBLICATIONS

"Ultra Guy Anchor Rod," (Data Sheet), Electronic Research, Inc., Publication No. 20090321011_AEN01, 2009.

"Assembling Your Antenna System," Luxorion, first downloaded Jun. 28, 2010 from http//www.astrosurf.com/luxorion/qsl-tower-assembly.htm.

"Corrosion Protection for Tower Structures," TechNotes, PolyPhaser Corporation, Global Lightning Solutions, 10701 Airport Drive, Hayden, ID, first downloaded Jun. 28, 2010.

Matthew J. Parker and William R. Hinz, "Examining Tower Guy Wire Anchor Rods," Westinghouse Savannah River Company, Aiken, South Carolina, first downloaded Jun. 28, 2010 from http://hps.ne.uiuc.edu/numug/archive/2002/presentations/parker-anchorrods.ppt.

Craig M. Snyder, "Understanding and Preventing Guyed Tower Failure Due to Anchor Shaft Corrosion," Sioux Falls Tower Specialists, Inc., AnchorGuard—Corrosion Control for Tower Anchors, Sioux Falls, South Dakota, first downloaded Jun. 28, 2010 from http://www.itrain online.org/itrainonline/mmtk/wireless_en/11_Communication_Tower/preventing_corrosion.pdf.

"Specifications," AnchorGuard, 2224 E 39th St N., Sioux Falls, SD 57104-5409, downloaded Jun. 28, 2010 from http://www.anchorguard.com/Specifications.pdf.

"Tower Corrosion Protection: Lightning Protections Information," first downloaded Jun. 28, 2010 from http://www.commomni.com/polyweb/corrosionprotect.htm.

PCT, International Search Report and Written Opinion of the International Searching Authority, PCT/US2011/033283, Jul. 7, 2011.

* cited by examiner

GUY ANCHOR REINFORCEMENT

CROSS-REFERENCES TO RELATED APPLICATIONS

This is a divisional application of U.S. application Ser. No. 12/890,565, filed on Sep. 24, 2010, which claims the benefit of U.S. Provisional Application No. 61/361,900, filed Jul. 6, 2010 and of U.S. Provisional Application No. 61/363,620, filed Jul. 12, 2010, which are incorporated herein by reference in their entireties.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO A "SEQUENCE LISTING," A TABLE, OR A COMPUTER PROGRAM LISTING APPENDIX

Not Applicable.

BACKGROUND OF THE INVENTION

1. Field of the Invention

This invention relates generally to guyed construction techniques, and, more particularly, to techniques for anchoring and for reinforcing the anchoring of guyed and additionally guyed towers.

2. Description of Related Art

Towers are widely used in many industries, including television transmission, radio communication, cell phone communication, wind turbines, and power transmission, to name a few.

Some towers, known as "guyed towers" or "additionally guyed towers," rely on guy wires to maintain or assist in maintaining the towers in a vertical orientation. Generally speaking, these towers include a vertical main body, or "mast," that stands on one end atop a base, which is generally concrete. Guy wires attach to the mast along its length, extend down and away from the mast, and attach securely to the ground using anchors. Most guyed towers are triangular in cross-section, and a minimum of three guy anchors are typically provided and are spaced apart by approximately 120-degrees to provide a stable base for holding the mast vertically. Often, guyed towers require three, six, or more guy anchors with multiple guy wires originating from different vertical levels of the tower attached to each guy anchor.

The term "guyed towers" describes towers whose masts have no independent means of support. They rely entirely upon guy wires to hold them upright. By contrast, the term "additionally guyed towers" describes towers that are essentially free standing, although they require guy wires to provide reinforcement and stability.

FIG. 1 shows a conventional guy anchor 100 for an erected tower. As shown in this example, four guy wires 110 originating from the tower's mast attach to an anchor head 114. The guy wires 110 are generally composed of steel or some other high tensile strength metal. A shaft 116 extends from the anchor head 114 and into the ground 124. Typically, the anchor head 114 and shaft 116, which are also generally made of steel, are provided as a single unit, with the shaft 116 permanently welded to the head 114. The distal end of the shaft 116 is typically buried in a steel-reinforced mass of concrete 118, also known as a "dead-man." The weight of the dead-man 118 and the earth above it holds the shaft 116 securely in place, even in the presence of large forces on the tower due to wind and precipitation.

The typical guy anchor assembly 100 may also include turnbuckles 112. One turnbuckle 112 is generally provided for each guy wire 110. The role of the turnbuckles 112 is to fine-tune the tightness of each guy wire 110.

To prevent damage due to lightning strikes, the guy wires 110 are each electrically connected via a conductive cable 120 to a ground spike 122. The ground spike 122 is typically made of copper. The cable 120 and ground spike 122 form a low impedance path to ground. This arrangement is designed to conduct high current surges away from the shaft 116, thereby preventing damage to the shaft which could otherwise compromise the mechanical stability of the tower.

As is known, the shafts 116 of the guy anchors typically corrode over time. Guy shaft corrosion primarily affects the area of the shaft exposed to soil, i.e., underground but outside the region encased in the dead-man 118. Corrosion may be galvanic in nature, with the steel guy shaft forming a battery cell with the more noble copper ground spike 122. Corrosion may also be electrolytic in nature, or may be caused by other factors.

Over several years, corrosion may lead to a significant loss of material from the anchor shaft 116, which, under the tensile forces transmitted through the guy wires, can result in a separation of the guy anchor shaft from the dead-man and a consequent catastrophic collapse of the tower.

The cost of replacing a collapsed 120 meter wireless guyed tower is estimated to be approximately $400,000. In addition, tower collapse poses a great risk to human life and property in the vicinity of the tower.

Owners and operators of guyed towers have developed aggressive remedial measures to prevent guy anchor failure. These include the following:

1. Inspecting the anchor shafts. This technique involves excavating around an existing anchor shaft to visually ascertain the status of the anchor shaft. Since the complete anchor shaft must typically be inspected, excavation is generally all the way to the dead-man 118. Removing earth above the dead-man temporarily weakens the guy anchor, and measures must be taken to retain the anchor in the ground as inspection proceeds.
2. Installing a new dead man anchor in front of the corroded anchor. This approach requires relocating the existing guy wires from the corroded anchor shaft to the new one.
3. Installing a new anchor behind the corroded anchor. Because distance to the tower mast is increased, this approach generally requires replacing all the guy wires, as they will be too short to re-attach to the new guy anchor. The additional space needed for the modified tower may require the tower owner to acquire new property or easements.
4. Installing a new drilled pier anchor offset to one side of the corroded anchor. This approach requires relocating the existing guy wires from the corroded anchor shaft to a new one. Towers with pinned bases may be caused to rotate to re-align themselves with the new anchors. Rotating the towers can sometimes be hazardous, and any antennas on the towers will generally need to be realigned. In addition, some towers have fixed bases and cannot freely rotate, in which case relocating the guy wires to new anchor heads can place additional stresses on the towers, which can lead to other problems.

BRIEF SUMMARY OF THE INVENTION

The above-identified remedial measures to prevent guy anchor failure are time consuming and expensive. We have recognized that they are also merely temporary solutions to the corrosion problem. Over time, corrosion of the anchor shafts will worsen or recur, and additional remedial measures will typically be required.

What is needed, therefore, is a measure for preventing or forestalling guy anchor failure that is less expensive and labor-intensive than currently employed measures and provides a longer-lived solution.

According to one embodiment, a reinforcing system is disclosed for a guy anchor of a guyed tower or additionally guyed tower. The guy anchor includes an anchor head and an anchor shaft extending from the anchor head into the ground. The reinforcing system includes a solid structure around a portion of the anchor shaft, a supplemental anchor shaft attached to the anchor head and extending into the solid structure, and a retaining structure attached to or integral with the supplemental anchor shaft within the solid structure. The solid structure has a top surface disposed above grade level. It has a front wall portion facing the tower and extending below the top surface into the ground, and a back wall portion extending below the top surface into the ground. The solid structure further includes a middle portion between the front wall portion and the back wall portion and extending into the ground. The front wall portion and back wall portion extend more deeply into the ground than the middle portion.

According to another embodiment, a reinforcing system is disclosed for a guy anchor that supports a structure. The guy anchor has an anchor head and an anchor shaft extending from the anchor head into the ground. The reinforcing system includes a solid structure disposed around the anchor shaft. The solid structure has a base and at least one wall extending down from the base having a surface that faces the structure being supported. The reinforcing system further includes a supplemental anchor shaft, attached to the anchor head and extending into the solid structure, and a retaining structure, attached to or integral with the supplemental anchor shaft and encased within the solid structure.

According to yet another embodiment, a tower includes a mast and a plurality of guy anchors. The guy anchors are positioned at locations around the mast. Each guy anchor has an anchor head and an anchor shaft extending from the anchor head into the ground. The tower further includes a plurality of guy wires attached between the mast and the plurality of guy anchors. At least one of the plurality of guy anchors is reinforced with a reinforcement that includes a solid structure disposed around the respective anchor shaft. The solid structure has a base and at least one wall extending down from the base having a surface that faces the mast. The reinforcement further includes a supplemental anchor shaft, attached to the anchor head and extending into the solid structure, and a retaining structure, attached to or integral with the supplemental anchor shaft and encased within the solid structure.

According to still another embodiment, a method of reinforcing a guy anchor is presented. The guy anchor has an anchor head and an anchor shaft extending from the anchor head into the ground. The method includes excavating a region around the guy anchor to form an excavated region, attaching a supplemental anchor shaft to the anchor head with the supplemental anchor shaft extending into the excavated region, introducing a curable material into the excavated region, and causing or allowing the curable material to cure into a solid structure.

According to a still further embodiment, a system for anchoring guy wires to support a structure includes an anchor head for attaching to one or more guy wires, an anchor shaft extending from the anchor head, a retaining structure attached to or integral with the anchor shaft at a distal end of the anchor shaft, and a solid structure. The solid structure encases the retaining structure. The solid structure has a base and at least one wall extending down from the base. Each wall has a surface in contact with soil that faces the structure being supported.

DETAILED DESCRIPTION OF THE INVENTION

As used throughout this document, words such as "comprising," "including," and "having" are intended to set forth certain items, steps, elements, or aspects of something in an open-ended fashion. Although certain embodiments are disclosed herein, it is understood that these are provided by way of example only and that the invention is not limited to these particular embodiments.

The techniques for reinforcing guy anchors as disclosed herein protect against corrosive failure of anchor shafts by providing a redundant support in the form of a supplemental anchor shaft encased in a solid structure. The supplemental anchor shaft does not generally come into contact with soil and is thus not exposed to the same corrosive environmental factors that affect the original anchor shaft. Preferably, the supplemental anchor shaft and solid structure are strong enough to completely replace the original anchor shaft and dead-man as the source of guy wire fixation. It is possible therefore for the original anchor shaft to corrode and completely disintegrate and the guy anchor to remain intact. Since the supplemental anchor is retained within the solid structure and generally has no direct and sustained contact with soil, it is relatively impervious to corrosion and is expected to provide a long service life as compared with conventional anchor shafts.

Figure 1:
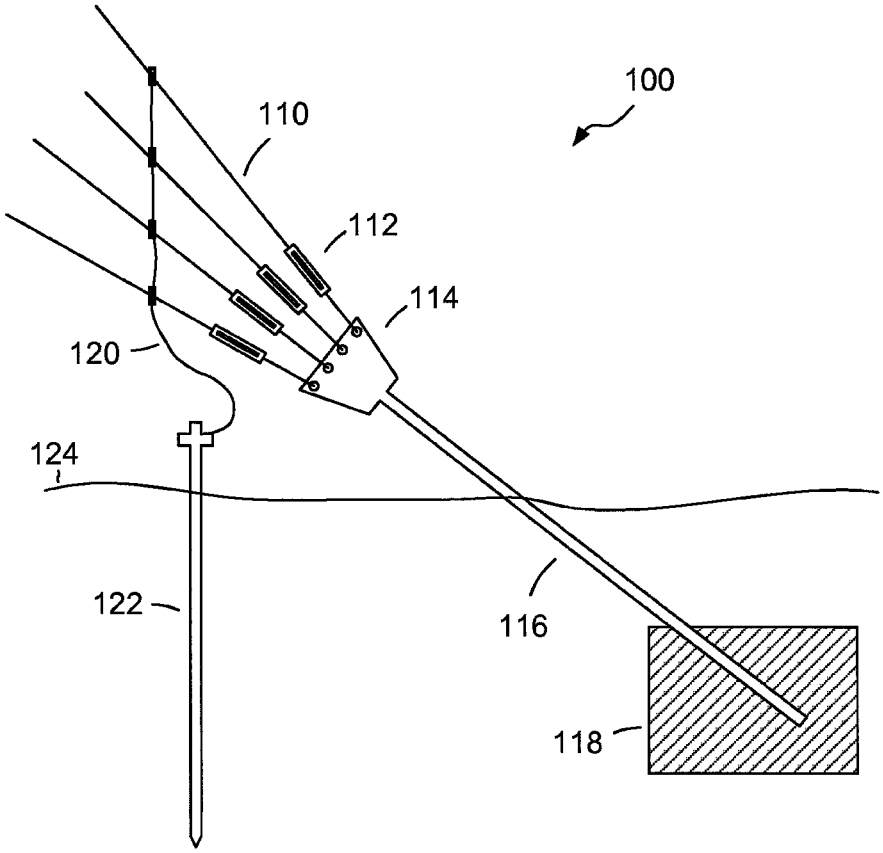
Fig. 1 (Prior Art)
FIG. 1 is an elevation view of a conventional guy anchor for supporting a tower according to the prior art.
Figure 2:
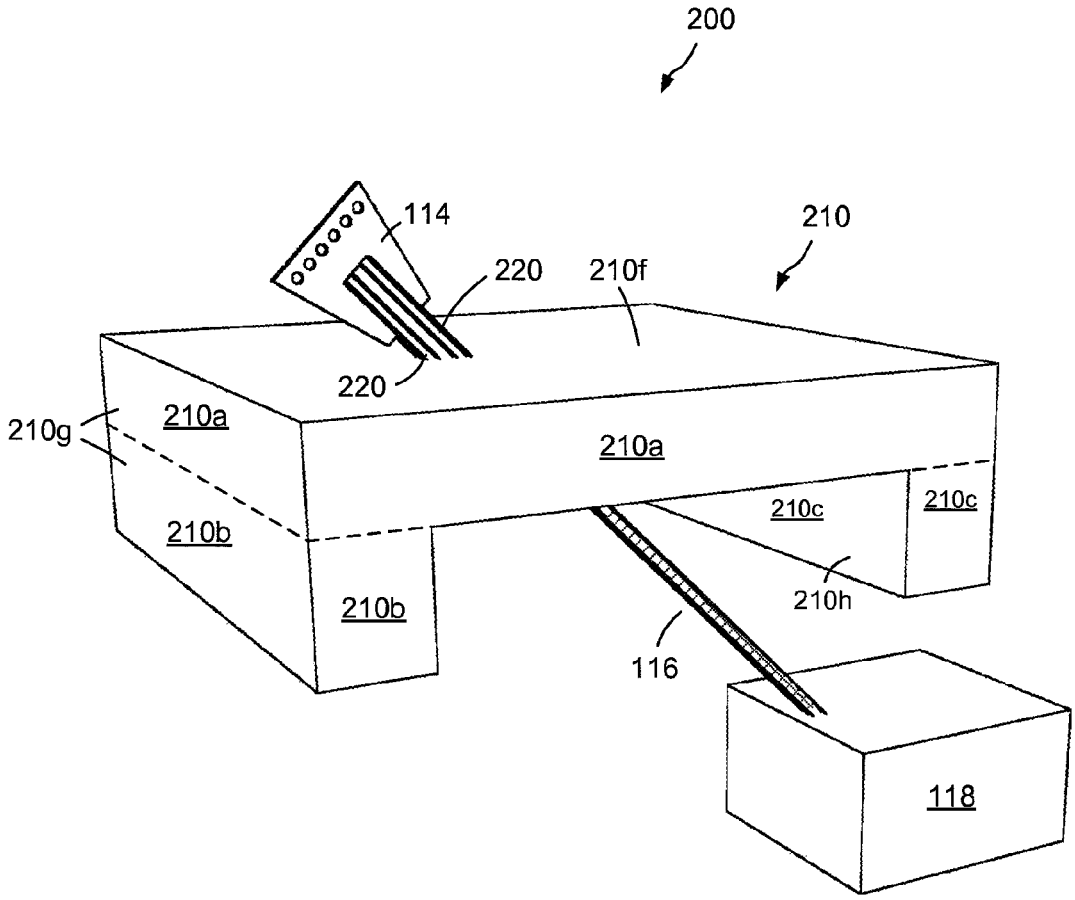
FIG. 2 is a perspective view of a reinforced guy anchor according to an illustrative embodiment of the invention.

FIG. 2 shows a reinforcing system as applied to an existing guy anchor according to an illustrative embodiment of the invention. The guy anchor is of the general type as shown in FIG. 1. It includes an anchor head 114 and an anchor shaft 116. The anchor shaft 116 extends from the anchor head 114, into the ground, and into a buried dead-man 118. The guy anchor is reinforced with a supplemental anchor shaft 220 and a solid structure 210, which is preferably reinforced concrete. The supplemental anchor shaft 220 is attached to the anchor head 114, extends parallel to the original anchor shaft 116, and is retained within the solid structure 210 with a retaining structure.

The solid structure 210 as shown has the shape of an inverted letter "U." It includes a base 210*a*, which generally has the shape of a rectangular prism, and a pair of walls or wall portions 210*b* and 210*c* extending down from the base. The solid structure 210 has a top surface 210*f*, a front wall surface 210*g*, and a back wall surface 210*h*. By convention, the "front" of the solid structure 210 faces in the direction of the tower. Both the front wall surface 210*g* and the back wall surface 210*h* face in the direction of the tower.

Figure 3:
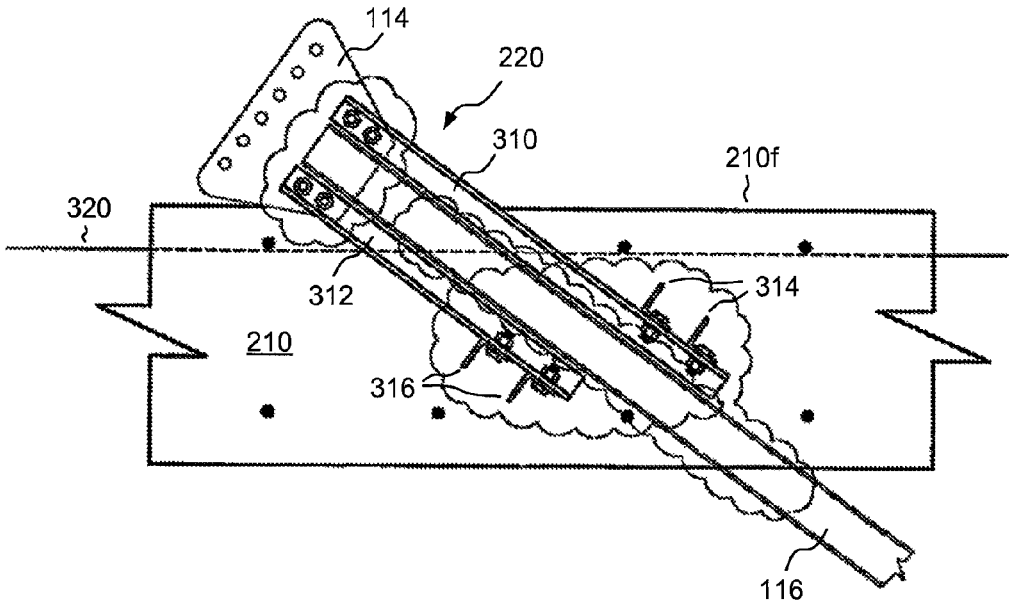
FIG. 3 is an elevation view of portions of the guy anchor reinforcing system of FIG. 2.

FIG. 3 shows an enlarged view of the reinforcing system. Portions of the solid structure 210 are transparent in this view to allow internal parts to be visualized. It can be seen that the supplemental anchor shaft 220 includes two elongated members, an upper elongated member 310 and a lower elongated member 312. The retaining structure is shown to include distal structures 314 and 316. Preferably, the elongated members 310 and 312 and the distal structures 314 and 316 are galvanized metal angle bars. The elongated members 310 and 312 are preferably bolted to the anchor head 114, although they may be attached by other means, such as welding. Similarly, the angle bars forming distal structures 314 and 316 are preferably bolted to the elongated members 310 and 312, although they too may be attached using other means.

The upper elongated member 310 is preferably longer than the lower elongated member 312. The difference in length allows the base 210 of the solid structure to be relatively shallow without exposing the elongated members 310/312 or distal structures 314 and 316 to soil.

It can be seen that the top surface 210*f* of the solid structure 210 is located slightly above grade level 320, preferably by about 5-8 cm (2-3 inches). With the top surface 210*f* above grade level, neither the elongated members 310/312 nor the distal structures 314/316 are exposed to soil. Thus, they are rendered relatively impervious to the degree of corrosion that affects anchor shafts buried in soil. Preferably, the top surface 210*f* is formed at a slight angle, with a slope facing the tower, to allow drainage and therefore prevent water from pooling around the guy anchor.

Figure 4:
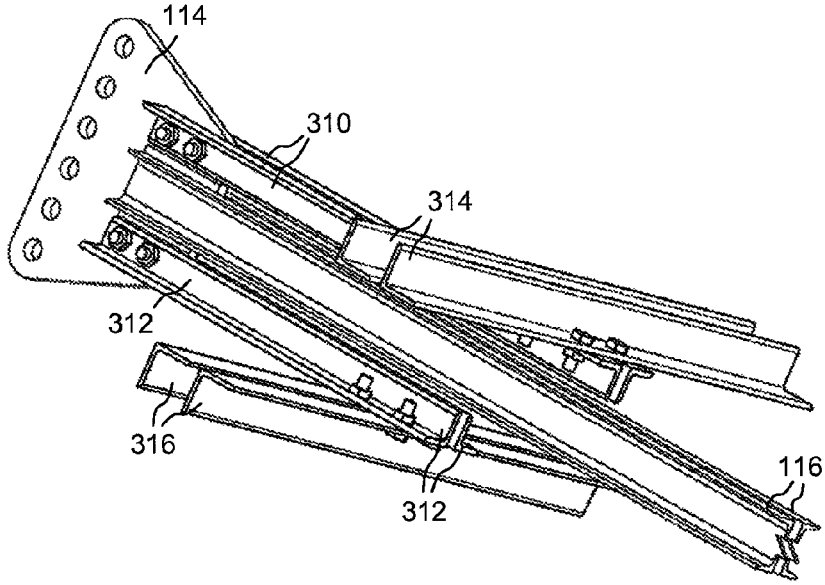
FIG. 4 is a perspective view of portions of the guy anchor reinforcing system of FIGS. 2-3.
Figure 5:
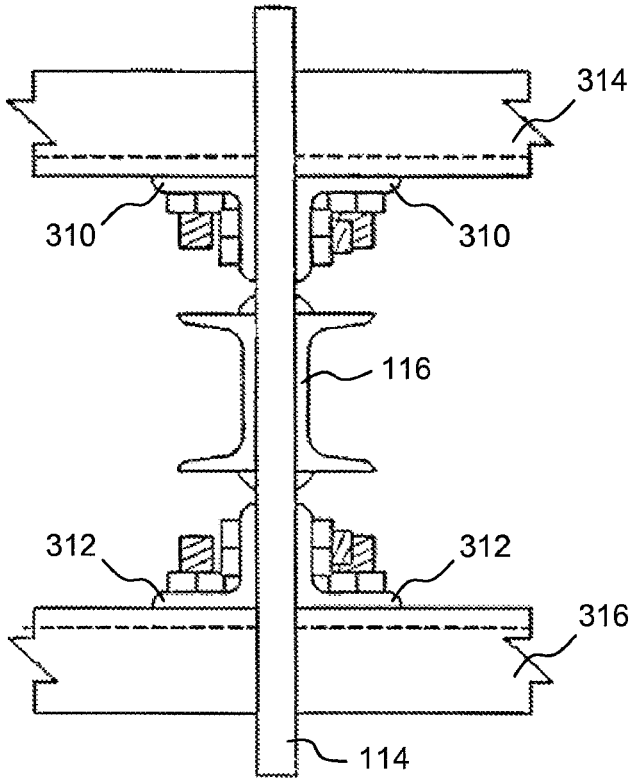
FIG. 5 is a view looking along the axis of the guy anchor shaft showing portions of the guy anchor reinforcing system of FIGS. 2-4.

FIG. 4 shows a perspective view of the reinforcing system with the solid structure 210 omitted. FIG. 5 shows the guy anchor as viewed looking down along the axis of the anchor shaft 116. From these figures, it is seen that the angle bars forming the distal structures 314 and 316 are themselves elongated, and they run perpendicularly to the elongated members 310/312. Preferably, the angle bars forming the distal structures have flat surfaces facing upward, parallel to the axis of the anchor shaft 116, and are thus well suited for resisting withdrawal of the guy anchor from the solid structure 210 in the presence of high tensile forces.

Figure 6:
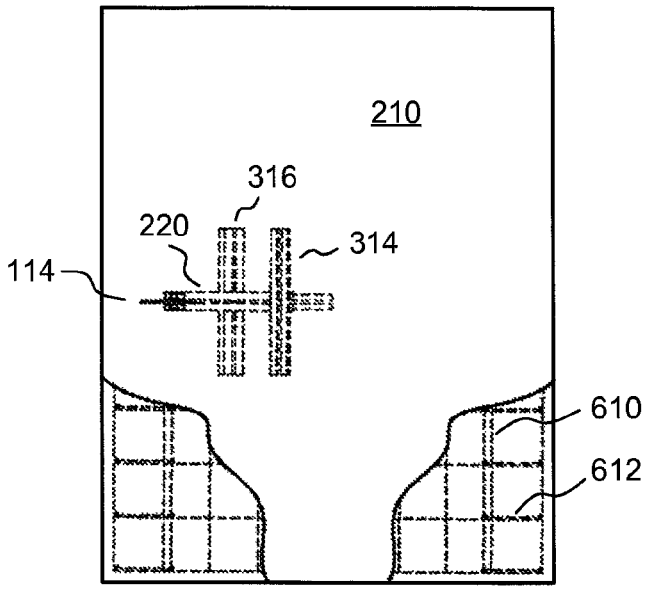
FIG. 6 is a plan view of the guy anchor reinforcing system of FIGS. 2-5.
Figure 7:
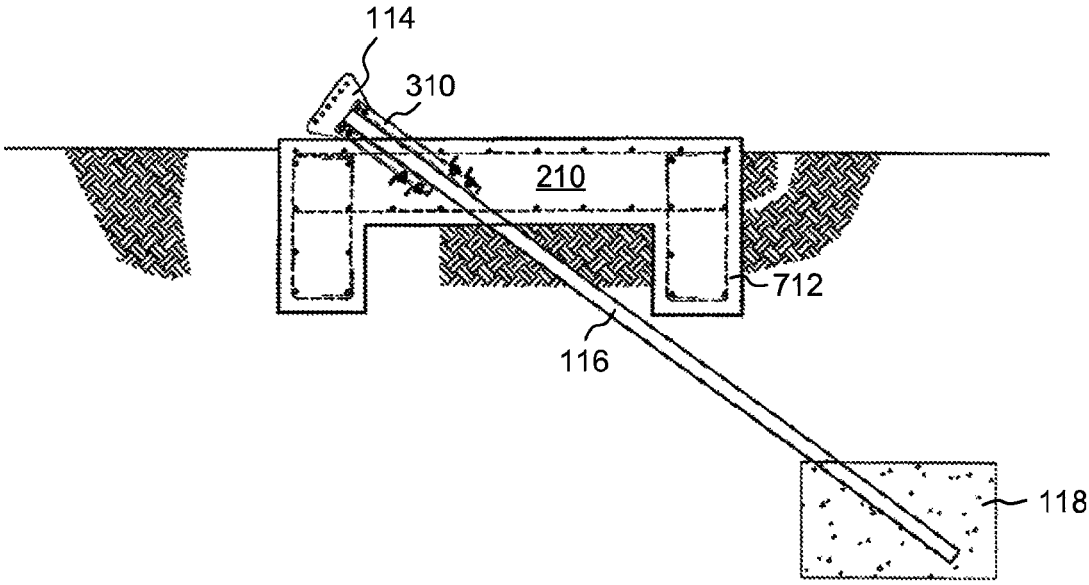
FIG. 7 is an elevation view of the guy anchor reinforcing system of FIG. 6.

FIGS. 6 and 7 respectively show plan and elevation views of the guy anchor and reinforcing system. It can be seen that the solid structure 210 is reinforced with a reinforcing material, such as rebar. Reinforcing the concrete protects it from cracking under tension. Tension tends to be greatest near the top surface 210*f* of the structure 210 near the supplemental anchor shaft 220 and at the corners where the wall portions 210*b* and 210*c* extend down. Therefore, reinforcement is especially necessary in these areas. Although the amount and size of rebar may vary based on site requirements, typically nine segments of #8 rebar 610 are evenly spaced along the width of the solid structure 210 near the top of the base 210*a*, and eleven segments of #8 rebar are evenly spaced along the depth. The same pattern of rebar is repeated near the bottom of the base. The walls 210*b* and 210*c* are also preferably reinforced with #8 rebar 712, which is typically provided at eleven different levels for each wall. Preferably, the rebar provided within the walls intersects the rebar within the base 210*a*, for added support. Although certain details of a rebar arrangement are shown and described, the actual rebar configuration used in any installation is a matter of design choice and may be varied in ways known to those skilled in the art.

The size of the solid structure 210 may be varied based on site requirements, with larger solid structures used for supporting larger towers or where greater tensile forces are present. The example shown is typical for a guy anchor placed at 38 m (125 feet) from a tower mast that stands 114 m (375 feet) tall, wherein worst case expected forces are approximately 89 kN (20 Kips) lateral and 89 kN (20 Kips) uplift and ample safety margins are provided. Given this example and the general information provided herein, the skilled practitioner can readily produce a myriad of other examples of different sizes, shapes, and proportions, to suit site requirements.

In the example shown, the solid structure 210 is approximately 2.4 m (8 feet) long and 3.0 m (10 feet) wide. The depth of the base 210*a* is approximately 46 cm (1.5 feet), with the walls 210*b* and 210*c* being approximately 61 cm (2 feet) deeper than the base. In general, and although this is not required, the walls 210*b* and 210*c* in most cases preferably extend into the ground at least twice as deeply as the base 210*a* of the solid structure.

In the example shown, the cross-sectional dimensions of the angle bars used for the elongated members 310 and 312 and the distal structures 314 and 316 are typically 5 cm×5 cm×1 cm (2"×2"×⅜"). The angle bars forming the distal structures 314 and 316 are typically approximately 1 m long (3 feet). All angle bars are preferably grade A36 steel, or better, and have a yield strength of at least 345 MPa (50 KSI). Nuts and bolts are typically 1.6 cm (⅝ inch), A325.

The angle bars used to form the elongated members 310 and 312 are preferably shipped to the installation sites in lengths of approximately 107 cm to 122 cm (3.5 to 4 feet). They are preferably cut to size, drilled, and bolted to the anchor head on site. The anchor head 114 itself is preferably drilled on site to allow attachment of the elongated members 310 and 312. Any field-cut edges or field-drilled holes are preferably galvanized with two coats of zinc rich galvanizing compound.

The concrete used to form the solid structure 210 preferably has a maximum compressive strength of at least 18 kPa (2500 PSI) at 28 days. All reinforced concrete construction and materials are preferably in accordance with ACI Standards 318. The minimum concrete cover over the rebar is preferably 7.6 cm (3 inches). All rebar is preferably Grade 60, and all reinforcing material is preferably in accordance with ASTM A615-85.

Figure 8:
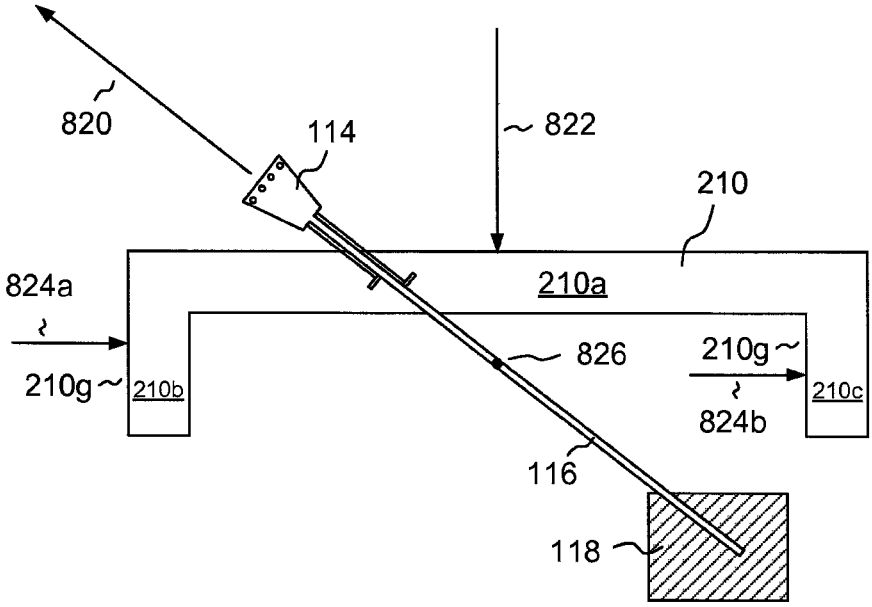
FIG. 8 is an elevation view of the reinforcing system of FIGS. 2-7 showing different forces acting thereupon.
Figure 9:
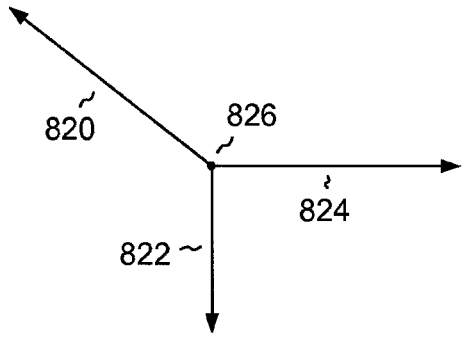
FIG. 9 is a simplified diagram of the forces shown in FIG. 8.

FIGS. 8 and 9 show forces acting upon the guy anchor and the solid structure 210. A first force 820 represents the resultant force from all the guy wires attached to the anchor head 114. A second force 822 represents with weight of the solid structure 210. The force 822 is directed straight down and passes through the center of mass of the solid structure 210. A third force 824 represents a lateral force produced when soil presses against the walls of the solid structure 210. This force is directed horizontally and opposite the direction of the tower. The third force 824 is the resultant of forces acting upon all surfaces of the solid structure 210, and particularly includes forces 824*a* and 824*b* acting upon the surfaces 210*g* and 210*h*, respectively. The vertical level at which the forces 824*a* and 824*b* act depends upon soil composition. With looser soil, such as sand, the forces will act at a lower vertical level, whereas with solid soil, such as clay, they will act at a higher vertical level. As long as the force 822 from the weight of the solid structure 210 exceeds the vertical component of the force 820 from the guy wires (with adequate safety margin), the solid structure 210 will remain in the ground under load.

Ideally, the three forces 820, 822, and 824 all intersect at a single point 826. This balanced design ensures that the solid structure 210 will not rotate under load, i.e., that neither its front wall 210*b* nor its back wall 210*c* will lift out of the ground and the structure will remain stable. Precise intersection of the three forces is preferred; however, only approximate intersection is needed for adequate operation, as small offsets are generally well tolerated. However, in cases where the three forces do not substantially intersect, a rigorous analysis should be conducted to ensure that the solid structure 210 will remain stable under load.

Generally, the solid structure 210 is placed relative to the guy anchor so that more of the mass of the solid structure lies behind the guy anchor than in front of it. This configuration naturally follows from the preferred condition that the 3 main forces intersect. In addition, different soil conditions typically involve different placements of the solid structure 210 with respect to the guy anchor. For example, placing the solid structure 210 in sandy soil tends to make the lateral force 824 act at a lower vertical level than it would ordinarily act in more solid soil. To ensure that the three forces 820, 822, and 824 substantially intersect at the same point when the solid structure is placed in sandy soil, the solid structure 210 should typically be placed farther back relative to the anchor head 114. Failing to do this will introduce a moment that tends to lift the back of the solid structure 210. Conversely, in very solid soil, the lateral force 824 generally acts at a higher vertical level, and positioning the solid structure 210 farther forward relative to the guy anchor is generally required to avoid a moment that tends to lift the front of the solid structure 210.

Figure 10:
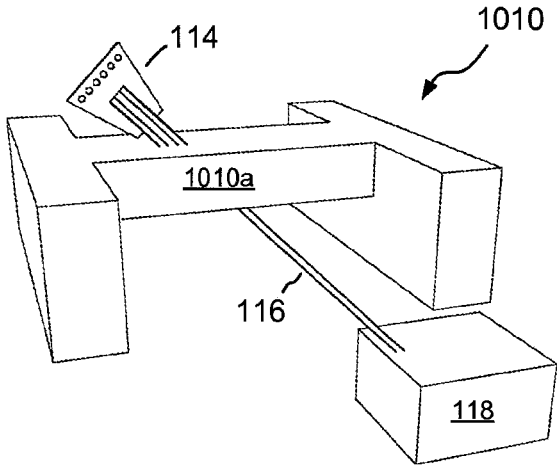
FIG. 10 is a perspective view of a second illustrative embodiment of the invention.

The shape of the solid structure 210 may be varied to better suit various site requirements. For example, FIG. 10 shows a solid structure 1010 with a narrowed base 1010*a*. Instead of the base having a rectangular shape, the base 1010*a* resembles that of a capital "H." The extent to which the base 1010*a* is reduced in size can be varied based on the desired weight of the solid structure 1010. The solid structure 1010 may be well-suited for applications in which lifting forces from the guy wires are relatively low in relation to horizontal forces, where lateral soil resistances are relatively low, where frost depths are relatively deep, or in fat clay soils. Under any of these conditions, the weight of the solid structure can generally be safely reduced. Reducing the amount of concrete reduces materials and cost.

Figure 11:
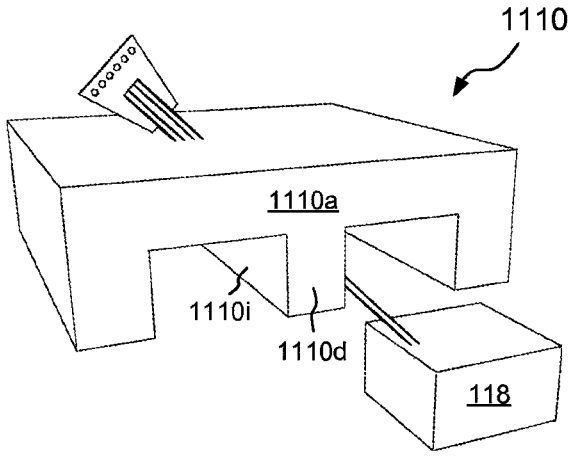
FIG. 11 is a perspective view of a third illustrative embodiment of the invention.

FIG. 11 shows another variant. Here, a solid structure 1110 is similar to the solid structure 210, except that it includes a third, or middle, wall or wall portion 1110*d*. The third wall 1110*d* is positioned between the other two walls and has a surface 1110*i* that faces toward the tower. The surface 1110*i* is in contact with soil, and the force of soil pressing against the surface 1110*i* contributes to the lateral force 824. The solid structure 1110 is particularly well suited for sites having loose and/or sandy soil or where additional lateral resistance is needed for stability. The third wall 1110*d* also adds weight to the solid structure 1110, and therefore may further be useful in cases where the solid structure must be both heavy and have a relatively small footprint. Additional walls, like the wall 1110*d*, may be provided where even greater lateral stability and/or weight are desired.

Figure 12:
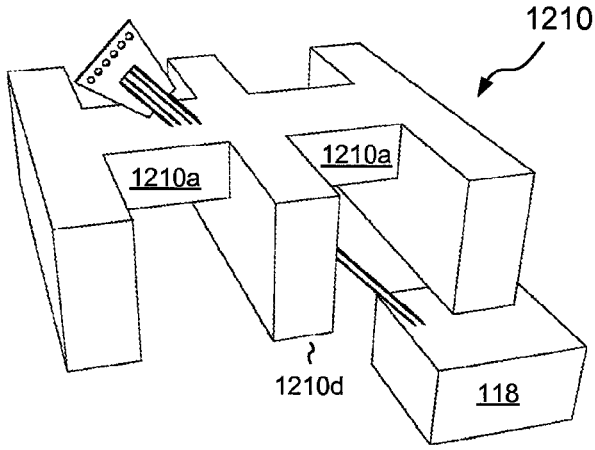
FIG. 12 is a perspective view of a forth illustrative embodiment of the invention.

FIG. 12 shows yet another variant, which combines the features of the two previous variants. Here, a solid structure 1210 has both a reduced base 1210*a* and a third wall or wall portion 1210*d*. Again, the reduction in the base 1212*a* may be varied based on desired weight of the solid structure, and such reduction is generally suitable under the same conditions and to provide the same benefits as the reduction of the base 1010*a* of FIG. 10. Similarly, additional walls or wall portions may be added, as desired for any particular installation. Any such additional walls or wall portions are generally suitable under the same conditions as for the solid structure 1110 of FIG. 11, and generally provide the same benefits.

Figure 13:
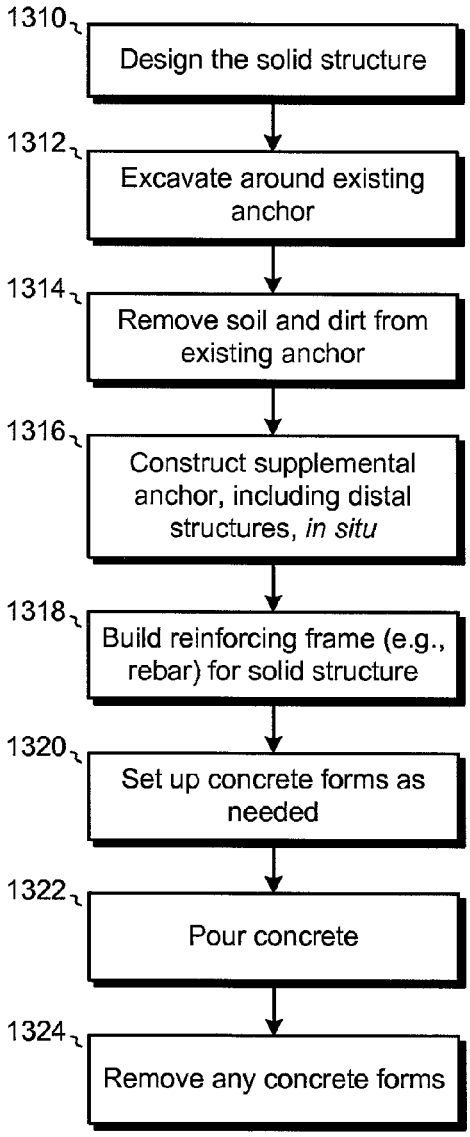
FIG. 13 is a flowchart showing a process for reinforcing a guy anchor according to an illustrative embodiment of the invention.

FIG. 13 shows an example of a process for reinforcing a guy anchor. The process generally begins with a design of a solid structure, such as any of the solid structures 210/1010/1110/1210 (Step 1310). The design step includes determining the desired size and shape of the solid structure, the number of walls, and the placement of the solid structure relative to the guy anchor. At Step 1312, a region around the guy anchor is excavated. The excavated region has size and shape that substantially match those of the designed solid structure (or rather, the portion thereof which is to be placed below grade level), in the designed location of the solid structure relative to the guy anchor. At Step 1314, the existing anchor shaft is cleaned to remove any soil or dirt. At Step 1316, the supplemental anchor shaft 220 is constructed. This step generally includes drilling the anchor head 114, cutting and drilling the elongated members 310 and 312, applying galvanizing compound to cut edges and drill holes, bolting the elongated members to the anchor head, and bolting the retaining structure (e.g., the distal structures 314 and 316) to the elongated members. At Step 1318, a reinforcing (rebar) frame for the solid structure is built within the excavated region. All rebar is preferably securely wire tied to prevent displacement during the concrete pouring. At Step 1320, any desired concrete forms are set in place. These may be needed especially to form portions of the solid structure that extend above grade level. Concrete is poured at Step 1322, and the concrete is allowed to cure. At Step 1324, any concrete forms that had been placed may be removed. Any gaps around the solid structure left by the concrete forms are preferably backfilled with well-compacted earth. The backfill is placed so as to prevent accumulation of water around the solid structure. The order of steps need not be precisely as shown in FIG. 13. For example, steps 1314-1320 may be performed in any desired order.

Figure 14:
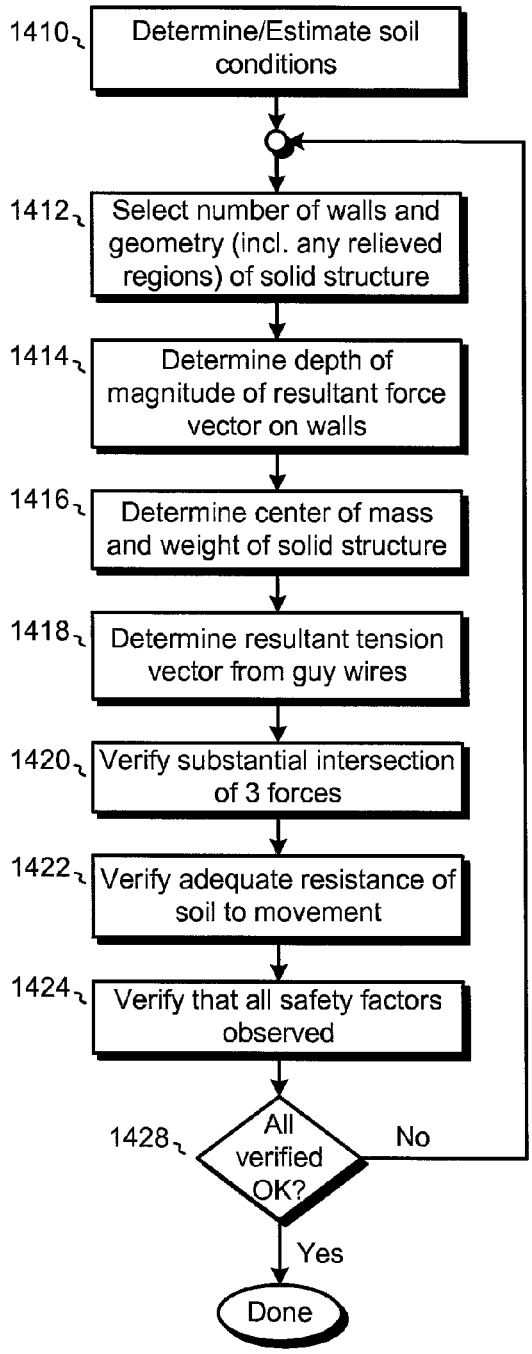
FIG. 14 is a flowchart showing a process for designing a solid structure to reinforce a guy anchor according to an illustrative embodiment of the invention.

FIG. 14 shows a detailed example of a process for designing the solid structure (see Step 1310 of FIG. 13). At Step 1410, soil conditions for the installation site are determined or estimated. The soil conditions which are considered include the type of soil (e.g., rocky, clay, or sandy) and the cohesiveness of the soil. At Step 1412, the geometry and number of walls of the solid structure are selected, including the extent to which any base portions of the solid structure are removed (as in FIGS. 10 and 13). These selections are preferably based on an initial assessment of the soil conditions, expected tensile forces from the guy wires (including both magnitude and direction), and adequate safety margins as recommended by industry best practices. Preferably, computations are then performed to verify the design. At Step 1414, the vertical depth and magnitude of the forces on the walls is calculated to determine the lateral force 824 (see FIGS. 8 and 9). At Step 1416, the center of mass and weight of the solid structure are calculated to determine the vertical force 822. At step 1418, the resultant tensile forces from the guy wires are calculated to provide the resultant force 820. Substantial intersection of these three forces (820, 822, and 824) is tested at Step 1420. The adequacy of soil resistance to lateral movement of the solid structure is tested at Step 1422, and the observation of all safety factors is tested at Step 1424. At Step 1428, it is determined whether any of the tests 1420, 1422, or 1424 have failed. If so, the design is iterated until one is selected that meets all requirements. It is understood that steps 1414-1418 and steps 1420-1424 are not required to be performed in any particular order.

The reinforcing system as disclosed herein provides a safer, less costly, and more permanent solution to corroding guy anchors than the conventional solution of completely replacing the corroded guy anchor. Since the solid structure is installed close to the surface, it eliminates large scale excavations and the need for highly skilled and costly tower crews. Indeed, the guy anchor reinforcement as set forth herein can generally be performed by a relatively inexpensive concrete crew.

The reinforcing system as disclosed herein eliminates the need to relocate the existing guy wires to new anchor heads, since the existing anchor head is used. Problems with tower rotation and antenna repositioning are therefore avoided.

The reinforcing system virtually eliminates expensive and sometimes hazardous full excavations of existing anchor shafts, which are conventionally used to inspect the guy anchors to determine the extent of corrosion. It is often less costly simply to install the reinforcing system disclosed herein than to perform the excavation needed to inspect for corrosion.

The reinforcing system as disclosed herein is a complete and potentially maintenance-free solution. As the new steel used to secure the existing anchor head is either above grade or encased in concrete, a tower site fitted with this solution may never experience anchor shaft corrosion within its expected service life.

Having described certain embodiments, numerous alternative embodiments or variations can be made. For example, as shown and described, the solid structure 210/1010/1110/1210 is symmetrical. However, this is merely an example. Alternatively, it may be asymmetrical. For example, the front wall may be larger (e.g., thicker, deeper, or wider) than the back wall, or vice-versa. Indeed, it may be beneficial to make one wall larger than the other in order to move the center of mass of the solid structure forward or back. Allowing asymmetry therefore provides an additional degree of freedom for aligning the 3 main forces acting upon the solid structure.

As shown and described, the walls of the solid structure are planar. However, this is merely an example. Alternatively, they may have a concave shape or some other shape.

The solid structure is shown and described as a single block. However, this is not strictly required. Alternatively, a plurality of smaller segments can be made and fastened and/or interlocked together. For example, the base of the solid structure can be made separately from the walls.

Preferably, the solid structure is made of reinforced concrete and reinforced concrete is believed to provide the best results. However, this is not strictly required. Other curable materials, including various polymers and cement, may be used, depending on design requirements and the performance of those materials.

As shown and described, the reinforcing system is used as a remedial measure to support an existing guy anchor where there is a concern that the anchor shaft may fail. However, it may also be used for primary anchor installations. The usual anchor shaft and dead-man can be omitted, and the guy anchor can be held in place with the primary guy anchor and the solid structure. With this arrangement, a relatively short anchor shaft is used. The retaining structure is attached to the distal end of the anchor shaft and is encased within the solid structure. This technique protects against anchor shaft corrosion and does not require deep excavations as are normally needed when installing a dead-man.

A variety of anchoring arrangements may be used for the supplemental anchor shaft 220. For example, different numbers of cross pieces may be provided for the distal structures 314 and 316. The elongated members and distal structures may be formed together as integral units and then cut to length on site. Although angle bars are preferred for the elongated members 310/312 and distal structures 314/316, any available shape could be used. For instance, on very large towers, these structures may be made from channels, flat plates, bars, or steel cables. In addition, the number of elongated members 310/312 or the number of distal structures 314/316 may be varied.

Although the guy anchor reinforcing techniques disclosed herein are shown and described for use with towers, it is understood that they may also be used with other types of structures that are supported with guy wires.

Those skilled in the art will therefore understand that various changes in form and detail may be made to the embodiments disclosed herein without departing from the scope of the invention.

TABLE

References Used in the FIGURES (flowchart references omitted)

| Reference Numeral | Description |
|---|---|
| 100 | Guy anchor |
| 110 | Guy wire(s) |
| 112 | Turnbuckle(s) |
| 114 | Guy anchor head |
| 116 | Guy anchor shaft |
| 118 | Dead-man |
| 120 | Electrically conductive cable |
| 122 | Ground spike (copper) |
| 124 | Grade level |
| 200 | Reinforced guy anchor |
| 210 | Solid structure |
| 210a | Base of solid structure |
| 210b | Front wall or wall portion |
| 210c | Back wall or wall portion |
| 210f | Top surface of solid structure |
| 210g | Tower-facing surface of front wall |
| 210h | Tower-facing surface of back wall |
| 220 | Supplemental anchor shaft |
| 310 | $1^{st}$ elongated member |
| 312 | $2^{nd}$ elongated member |
| 314 | $1^{st}$ distal structure |
| 316 | $2^{nd}$ distal structure |
| 320 | Grade level |
| 610 | Reinforcement (rebar, width-wise) |
| 612 | Reinforcement (rebar, length-wise) |

TABLE-continued

References Used in the FIGURES (flowchart references omitted)

| Reference Numeral | Description |
|---|---|
| 712 | Reinforcement (rebar) for walls |
| 820 | Resultant force from guy wires |
| 822 | Force from weight of concrete |
| 824a, 824b, 824 | Horizontal forces on each wall, and resultant force |
| 826 | Point at which 3 forces intersect |
| 1010 | Solid structure with reduced base |
| 1010a | Base of solid structure 1010 |
| 1110 | Solid structure with middle wall |
| 1110a | Base of solid structure 1110 |
| 1110d | Middle wall of solid structure 1110 |
| 1110i | Surface of middle wall 1110d facing tower |
| 1210 | Solid structure with middle wall and reduced base |
| 1210a | Base if solid structure 1210 |
| 1210d | Middle wall of solid structure 1210 |

What is claimed is:

1. A method of reinforcing a guy anchor having an anchor head and an anchor shaft extending from the anchor head into the ground, the method comprising:

excavating a region around the guy anchor to form an excavated region;

attaching a supplemental anchor shaft to the anchor head with the supplemental anchor shaft extending into the excavated region;

introducing a curable material into the excavated region; and allowing the curable material to cure into a solid structure, wherein excavating the region around the guy anchor includes excavating first and second regions in front of and behind the anchor head, respectively, and a third region between the first and second regions, wherein the first and second regions are excavated more deeply than the third region.

2. The method as recited in claim 1, wherein introducing the curable material into the excavated region results in the curable material extending above grade level.

3. The method as recited in claim 1, further comprising, prior to introducing the curable material into the excavated region, attaching a distal retaining structure to the supplemental anchor shaft, wherein introducing the curable material encases the distal retraining structure within the curable material.

4. The method as recited in claim 1, further comprising reinforcing the curable material with steel.

5. The method as recited in claim 1, wherein the first and second regions are excavated at least twice as deeply as the third region.

6. The method as recited in claim 1, wherein excavating the region around the guy anchor further includes excavating at least a forth region between the first and second regions, wherein the forth region is deeper than the third region.

7. The method as recited in claim 1, wherein excavating the region around the guy anchor comprises excavating a larger region behind the anchor head than in front of it.

8. The method as recited in claim 1, wherein the solid structure has a center of mass, and wherein the method further comprises positioning the excavated region relative to the anchor head to cause the following three forces substantially to intersect in space: a downward force from a center of mass of the solid structure, an equivalent lateral force from soil pressing laterally against the solid structure, and a resultant force from guy wires attached to the anchor head.

9. A method of reinforcing a guy anchor having an anchor head and an anchor shaft extending from the anchor head into the ground, the method comprising:

excavating a region around the guy anchor to form an excavated region having a vertical front surface in front of the anchor head;

attaching a supplemental anchor shaft to the anchor head such that the supplemental anchor shaft extends into the excavated region parallel to the anchor shaft; and introducing a curable material into the excavated region, the curable material encasing at least a portion of the supplemental anchor shaft and forming a front wall at the vertical front surface of the excavated region that faces a structure that the guy anchor supports, wherein excavating the region around the guy anchor includes excavating to a first depth at a front portion of the excavated region coextensive with the vertical front surface and excavating to a second depth behind the front portion of the excavated region, wherein the first depth is deeper than the second depth.

10. The method of claim 9, wherein excavating the region around the guy anchor further includes excavating a back portion behind the anchor head to a depth that is deeper than the second depth, and wherein the curable material in the back portion forms a second wall facing the structure supported by the anchor shaft.

11. The method of claim 10, wherein excavating the region around the guy anchor further includes excavating a middle portion between the front portion and the back portion to a depth that is deeper than the second depth, and wherein the curable material in the middle portion forms a second wall facing the structure supported by the anchor shaft.

12. The method of claim 9, further comprising, prior to introducing the curable material, attaching a retaining structure to the supplemental anchor shaft at a location along the supplemental anchor shaft that will be encased within the curable material after the curable material is introduced.

13. The method of claim 12, wherein attaching the supplemental anchor shaft includes attaching first and second elongated members to the anchor head above and below the anchor shaft, and wherein attaching the retaining structure includes attaching a first retaining portion to the first elongated member and attaching a second retaining portion to the second elongated member.

14. The method of claim 12, wherein attaching the retaining structure to the supplemental anchor shaft is performed within the excavated region after attaching the supplemental anchor shaft to the anchor head.

15. The method of claim 9, further comprising, prior to introducing the curable material, constructing a structure within the excavated region to reinforce the curable material.

16. The method of claim 15, wherein the structure includes a first set of rods that run perpendicular to the vertical front surface of the excavated region and a second set of rods that run perpendicular to the first set of rods and parallel to the ground.

17. The method of claim 9, further comprising placing forms around the excavated region to contain curable material that extends above grade level when introducing the curable material.

18. The method of claim 17, further comprising allowing the curable material to cure into a solid structure and removing the forms placed around the excavated region.

* * * * *